US005794367A

United States Patent [19]

Carroll

[11] Patent Number: 5,794,367

[45] Date of Patent: Aug. 18, 1998

[54] SPORTS SHOE CLEATS

[75] Inventor: Francis C. Carroll, Philadelphia, Pa.

[73] Assignee: GreenKeepers, Inc., Philadelphia, Pa.

[21] Appl. No.: 802,908

[22] Filed: Feb. 20, 1997

[51] Int. Cl.[6] ..... A43B 5/00; A43B 15/00

[52] U.S. Cl. ..... 36/134; 36/127; 36/67 R; 36/67 D

[58] Field of Search ..... 36/127, 134, 67 R, 36/67 A, 67 D, 59 A, 59 C

[56] References Cited

U.S. PATENT DOCUMENTS

| | | | |
|---|---|---|---|
| 39,575 | 8/1863 | Hyatt et al. | 36/67 A |
| 180,578 | 8/1876 | Gunsalus | 36/67 D |
| 2,095,095 | 10/1937 | Howard | 36/134 |
| 3,082,549 | 3/1963 | Dolceamore | 36/134 |
| 3,354,561 | 11/1967 | Cameron | 36/134 |
| 3,466,763 | 9/1969 | Levin | 36/134 |
| 3,656,245 | 4/1972 | Wilson | 36/67 D |
| 4,014,114 | 3/1977 | Jordan et al. | 36/67 D |
| 4,327,503 | 5/1982 | Johnson | 36/67 A |
| 4,402,145 | 9/1983 | Dassler | 36/59 C |
| 5,533,282 | 7/1996 | Kataoka et al. | 36/67 R |
| 5,581,913 | 12/1996 | Kataoka et al. | 36/59 C |

FOREIGN PATENT DOCUMENTS

| | | | |
|---|---|---|---|
| 524861 | 1/1993 | European Pat. Off. | 36/134 |
| 3811513 | 10/1989 | Germany | 36/134 |

*Primary Examiner*—M. D. Patterson

*Attorney, Agent, or Firm*—Jim Zegeer, Esq.

[57] ABSTRACT

A sport shoe cleat especially for golf shoes has a main body member having a dome-shaped outer face and a planar inner face, a threaded stud molded integrally with the main body member and projecting outwardly from the inner face. A plurality of pseudo pyramid-shaped teeth projecting around the perimeter of the main body member, each of the pseudo pyramid-shaped teeth having an outward angle to provide lateral stability and traction through the plane of a sports swing. The traction teeth have a low profile to reduce damage to putting green surfaces for example. The body member has a wear pad at the center of said dome-shaped outlet face, the wear pad being a weight-bearing surface such as to support the majority of the body weight placed on the cleat and keeping weight off the traction teeth to prolong the life of the traction teeth and the cleat. The dome shape and wear pad being adapted so that the body weight is directed toward the center of the cleat so that it wears from the inside out and that as the cleat wears from the inside out, the traction teeth also wear in an outward manner to allow the traction teeth to maintain the outward angle needed to provide lateral traction throughout the life of the cleat.

16 Claims, 3 Drawing Sheets

SPORTS SHOE CLEATS

The present invention is directed to sports shoe cleats, and more particularly to golf shoe cleats or spikes in which the cleat is molded from a durable plastic material.

BACKGROUND AND BRIEF DESCRIPTION OF THE INVENTION

The three biggest complaints made about existing golf shoe spikes or cleats are lack of traction and durability, that they need to be cleaned off during the course of a game. There have been attempts to solve these problems in the past. In U.S. Pat. Nos. 5,536,793 and 5,259,129, the golf cleat or spike is comprised of a plastic molding in which the traction action is provided by ridges curved in planes parallel to the shoe sole emanating out in radial fashion from the center of the disk-like flange and being integrally formed with and extending down from the bottom of the surface. In U.S. Pat. No. 4,723,366, a traction cleat is provided which has a metal stud infrastructure at the core of the cleat and a plastic skirt molded directly on the flange of the metal infrastructure. The curved rib structure of the above Deacon et al patents is also disclosed in Design U.S. Pat. No. 375,192; U.S. Pat. No. Des. 372,355; U.S. Pat. No. Des. 371,453 and U.S. Pat. No. Des. 366,755. The object of the present invention is to provide an improved golf shoe spike or cleat in which the spikes offer better traction and lateral stability.

THE PRESENT INVENTION

The present invention provides a golf shoe cleat or spike which utilizes low profile pseudo pyramid-like shaped "traction teeth". Although the pseudo pyramid shape is preferred, other geometric shapes can be used. For example, the traction teeth can be conically shaped. One or more center teeth protrude straight down to provide traction, and the teeth are in a generally circular perimetrical pattern and protrude at an outward angle to provide lateral stability during a golf swing. Due to the orientation of the teeth, the cleat is more durable. Moreover, a material is utilized which not only provides resilience and flexibility for traction but also possesses a durability characteristic needed to achieve an acceptable product life. In addition, the cleat of the present invention helps keep the build-up of debris to a minimum. The or traction teeth and dome-shaped outer face are designed to move debris outwardly away from the traction teeth. According to the cleat of the present invention, the outward angle traction teeth around the perimeter, unlike any other cleat, provides lateral stability and traction through the plane of a golf swing. These teeth are low in profile (e.g. are shorter than conventional spikes) to reduce damage to putting green surfaces. In addition, the cleat has a wear pad in the center. This is a weight-bearing surface. Although it may offer some traction, it is there to support the majority of the body weight placed on the cleat, tending to keep weight off the traction teeth to prolong the life of the teeth and the cleat.

Because most of its body weight is directed toward the center of the cleat, it wears from the inside out. As the cleat wears from the inside out, the traction teeth also wear in an outward manner. This allows the teeth to maintain the desired outward angle needed to provide lateral traction throughout the life of the cleat.

The preferred material for the construction is a polyurethane material with a 55 D durometer hardness. However, it can be manufactured out of any suitable material with a preferred hardness range from 45 D to 95 D durometer hardness.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
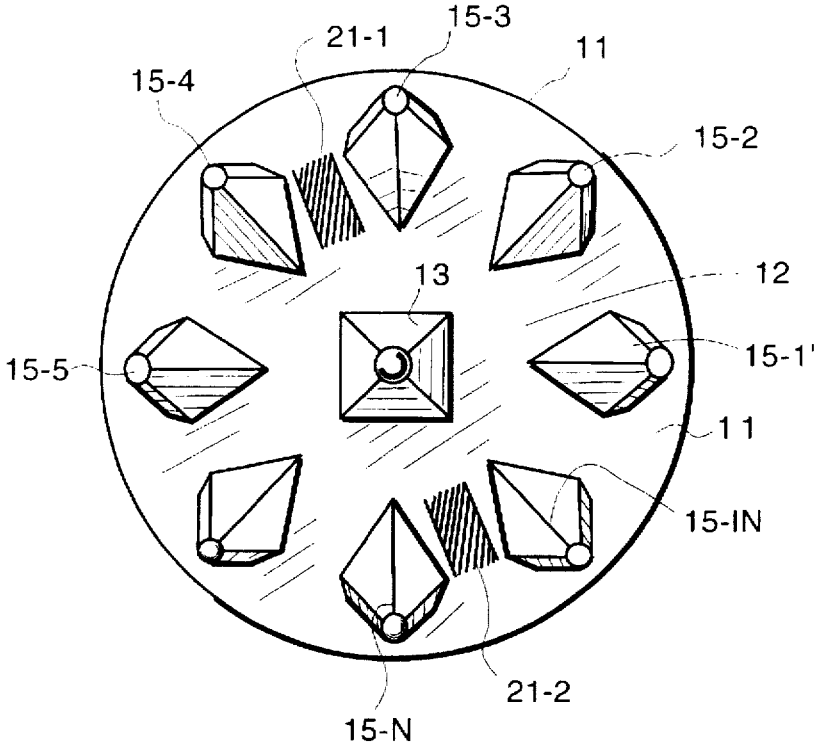
FIG. 1 is a front view of a golf shoe cleat incorporating the invention.
Figure 2:
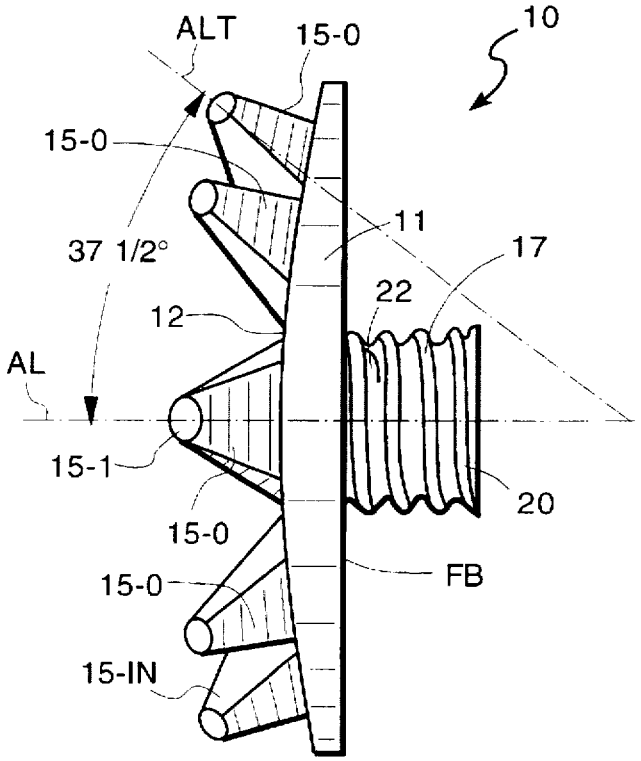
FIG. 2 is a side elevational view of the golf shoe cleat incorporating the invention.
Figure 3:
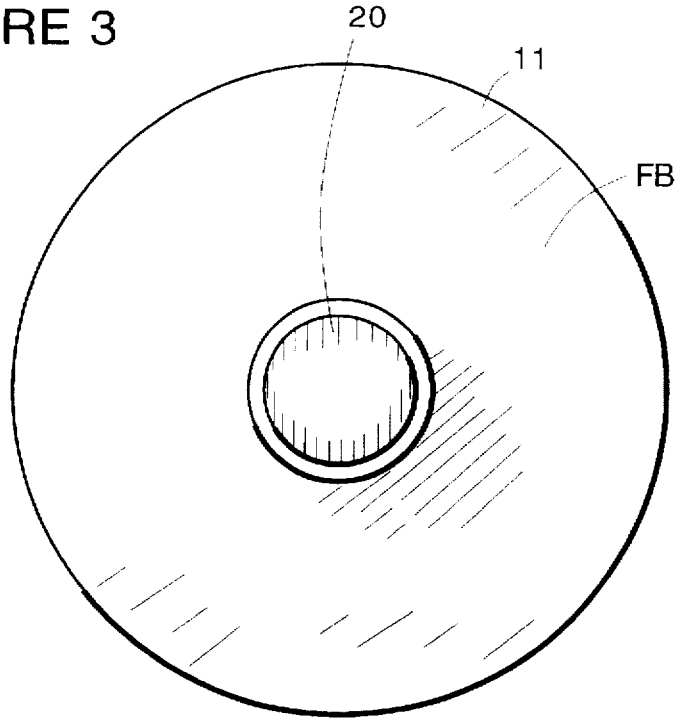
FIG. 3 is a back view of the golf shoe incorporating the invention.
Figure 4:
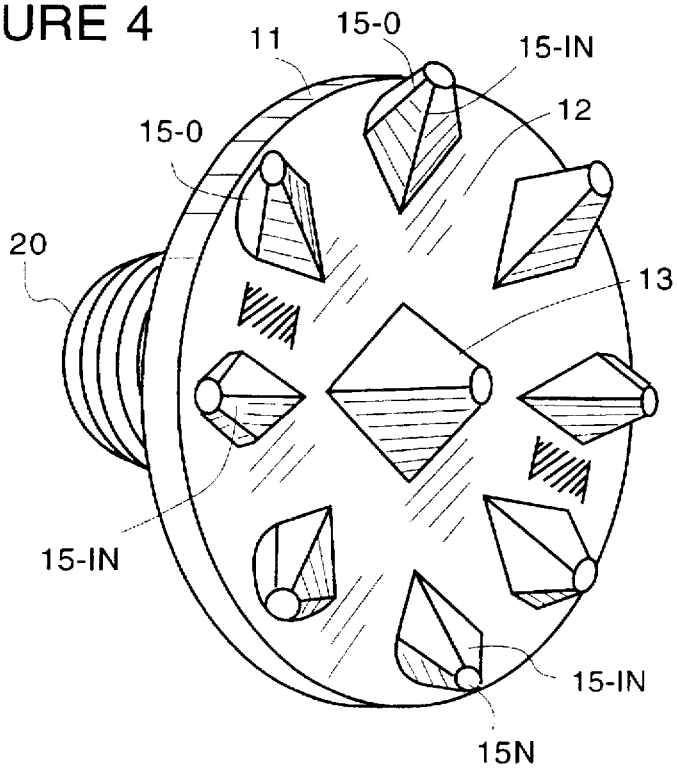
FIG. 4 is a ¾ angle isometric view of the golf shoe spike or cleat incorporating the invention.

Referring now to FIGS. 1–4 of the drawings, a cleat 10 is preferably of molded plastic polyurethane with a 55 D durometer hardness but which can be manufactured out of any suitable material with a preferred hardness range from 44 D to 95 D durometer hardness. The body 11 has a domed outer face 12 with a center-pyramid shaped wear pad 13 surrounded by an array of pseudo pyramid-shaped traction teeth 15-1, 15-2 . . . 15-N, and in the present embodiment N is 8, so that in the cleat illustrated, there are nine teeth with the center tooth 13 serving as a wear pad. The pseudo pyramid-shaped teeth have a curved outer face 15-O and an angulated or faceted inner face 15-IN. Each of the teeth in the array 15-1, 15-2, 15-3 . . . 15-N are traction teeth and are angled outwardly around the perimeter. This outward angle provides lateral stability and traction through the plane of a golf swing. In one preferred embodiment this outward angulation is at an angle of about 37½°, e.g. measured from axial line AL perpendicular to the pyramid-shaped wear pad 13 to the axial line ALT of each tooth. In a preferred embodiment each traction tooth has a low profile, and in this preferred embodiment the wear pad 13 has a depth of about 0.163 inches as shown in FIG. 2. Moreover, these teeth are low in profile to reduce damage to putting green surfaces, and the peak or tip 16-1, 16-N2 . . . 16-N of each tooth 15-1, 15-2 . . . 15-N is flat or rounded.

This configuration of the teeth of the cleat whereby the pseudo pyramid-shaped traction teeth 15-1, 15-2 . . . 15-N are angled outward around the perimeter of body 11 provides both lateral stability and traction through the plane of a golf swing (or the swing of a batter in baseball or softball, etc.). These teeth, as noted above, are low in profile to reduce damage to the putting greens and preferably do not have sharp points. In addition, the wear pad 13 in the center of the dome-shaped body member 11 provides a weight-bearing surface. Although this may offer some traction, its main purpose is to support the majority of the body weight placed on the cleat, keeping weight off the traction teeth to prolong the life of the teeth and the cleat. Since most of the body weight is directed toward the center of the cleat, it wears away from the inside out. As the cleats or teeth 15-1, 15-2 . . . 15-N wear from the inside out, the traction teeth also wear in an outward manner. This allows the teeth to maintain the desired outward angle needed to provide lateral traction throughout the life of the cleat.

Figure 5:
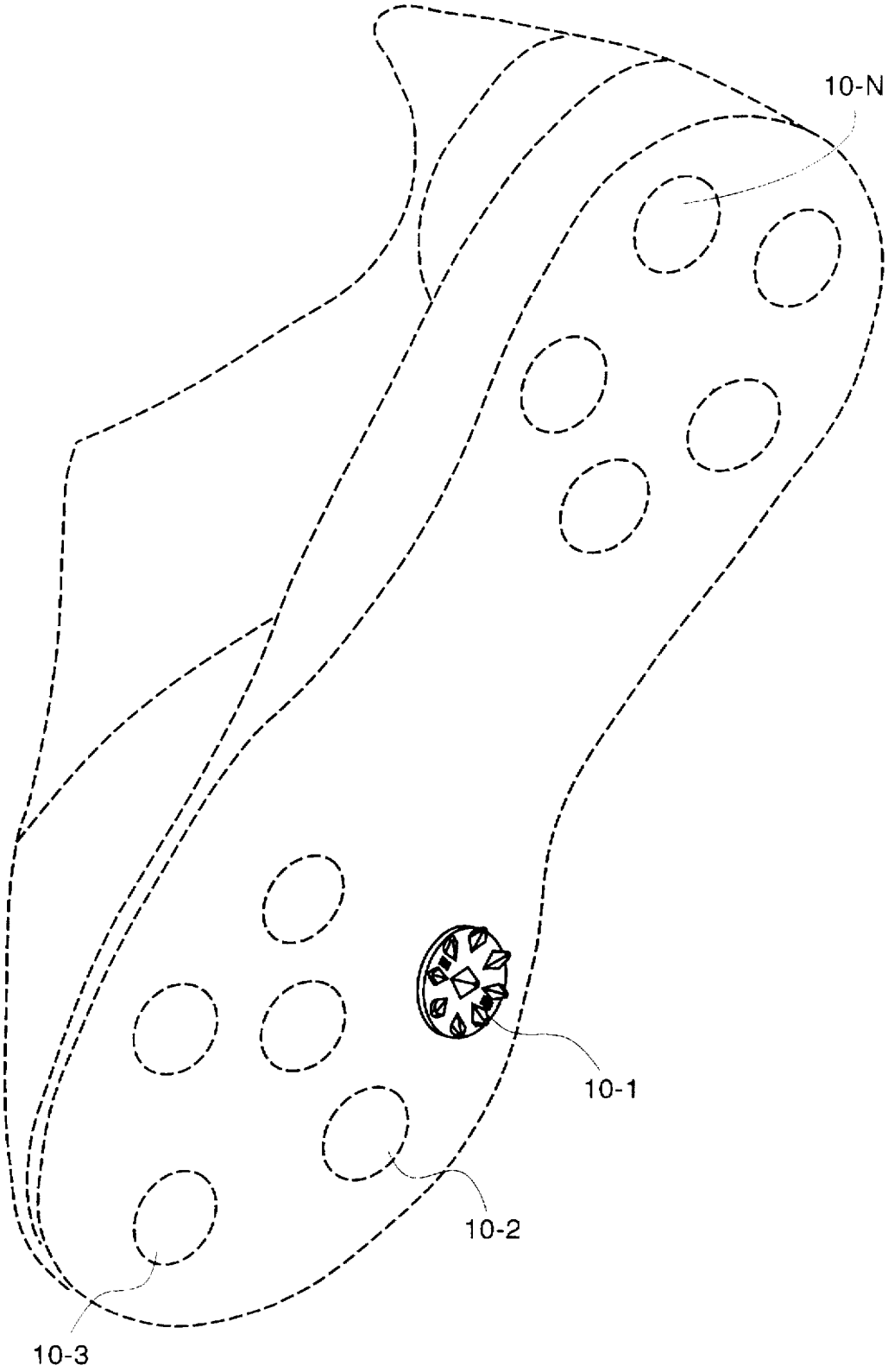
FIG. 5 is an isometric perspective view of a golf or sports shoe with a cleat incorporating the present invention installed.

A pair of rectangular (or circular) depressions 20, and 21 are adapted to accept the conventional two-prong installation tool which fits into engagement in recesses 21-1 and 21-2 to provide torque and rotation of the golf cleat so as to cause the threads 17 which are engaged with are engaged with the conventional threaded cleat holes in the bottom of a conventional golf shoe as shown in FIG. 5 in which a plurality of cleats 10-1, 10-2 . . . 10-N have been installed.

The threads of threaded studs 20 adjacent the flat base FB of the main body member 11 are provided with a plastic fillet 22 which serves the function of locking the cleat in the threaded bore of the cleat receptacle on the shoe.

As noted earlier, the preferred material for construction of the shoe is a polyurethane with a 55 d durometer hardness but which can be manufactured out of any suitable material with a preferred hardness ranging from about 45 d to 95 d durometer hardness.

While the invention has been shown and described in the reference to a preferred embodiment of the invention, it will be understood that the invention is not limited thereto but may be modified, adapted and changed by those skilled in the art and still be within the scope of the invention as defined by the following claims:

What is claimed is:

1. A sports shoe cleat comprising a body member having an outer face and an inner face, a threaded stud molded integrally with said main body member and projecting outwardly from said inner face and having an axis perpendicular to said inner face, a plurality of perimeter traction teeth projecting around the perimeter of said outer face, and a central wear tooth having an axis AL aligned with the axis of said threaded stud member and wherein each perimeter traction tooth has an axial line ALT which is angled outward relative to said axis AL to provide lateral stability and enhanced traction.

2. The sports shoe cleat defined in claim 1 wherein said perimeter traction teeth have an inside surface facing said central wear tooth and an outside surface facing away from said central wear tooth, and said inside surface is pyramid-shaped and said outside surface is cone-shaped.

3. The sports shoe cleat defined in claim 1 wherein said sports shoe cleat is molded from a polyurethane having a hardness range from 45 D to 95 D durometer hardness.

4. The sports shoe cleat defined in claim 1 wherein said central wear tooth is encircled by said traction teeth and wherein each traction tooth is angled about 37½° measured from said axis AL passing axially through the center of wear tooth and said axial line ALT passing axially through each traction tooth, respectively.

5. A golf shoe cleat comprising a main body member having a dome-shaped outer face and a planar inner face, a threaded stud molded integrally with said main body member and projecting vertically outwardly from said inner face, said main body member having a circular perimeter, a plurality of perimeter traction teeth circumferentially spaced around said circular perimeter of said main body member, each tooth having an outward angle to provide lateral stability and traction through the plane of a golf swing, said body member having a central wear pad at the center of said dome-shaped outer face, said central wear pad being a weight-bearing surface such as to support the majority of the body weight placed on the cleat and tending to keep weight off said traction teeth to prolong the life of said traction teeth and the golf shoe cleat.

6. The golf shoe cleat defined in claim 5 wherein said traction teeth are pseudo pyramid-shaped.

7. The golf shoe cleat defined in claim 5 wherein said cleat is molded from a polyurethane having a hardness range from 45 D to 95 D durometer hardness.

8. The golf shoe cleat defined in claim 7 wherein said plastic material is polyurethane having a hardness of about 55 D durometer hardness.

9. The golf cleat defined in claim 5 wherein said threaded stud has a helical groove extending from the base of said main body member outwardly and an at least one plastic fillet member bridging a portion of said helical groove so as to prevent loosening of said cleat during use.

10. A golf shoe cleat comprising a main body member having a dome-shaped outer face and a generally planar inner face, a threaded stud molded integrally with said main body member and projecting outwardly from said inner face and having an axis AL which is perpendicular to said generally planar inner face, a plurality of pseudo pyramid-shaped teeth projecting around the perimeter of said main body member, each said pseudo pyramid-shaped teeth having an axial line ALT exiting at an outward angle relative to said axis AL to provide lateral stability and traction through the plane of a golf swing, said teeth being in a low profile to reduce damage to putting green surfaces, said body member having a wear pad at the center of said dome-shaped outer face, said wear pad being a weight-bearing surface such as to support the majority of the body weight placed on the cleat and keeping weight off said traction teeth to prolong the life of said traction teeth and the cleat, said dome shaped outer face and wear pad being adapted so that the body weight is directed toward the center of the cleat so that it wears from the inside out and that as the cleat wears from the inside out, said traction teeth also wear in an outward manner to allow said traction teeth to maintain said outward angle needed to provide lateral traction throughout the life of the cleat.

11. A golf shoe cleat comprising a main body member having a dome-shaped outer face and an inner face, a threaded stud extending integrally from said main body member and projecting vertically outwardly from said inner face and having an axis AL, a wear pad at the center of said dome-shaped outer face, said wear pad having an axis which is co-linear with said axis AL and constituting a weight bearing surface such as to support the majority of the body weight placed on said golf shoe cleat, a plurality of perimeter traction teeth in a circular array around said wear pad, each perimeter traction tooth having an axis ALT which is at an outward angulation relative to said axis AL to provide lateral stability and enhanced traction through said dome of a golf swing, said dome-shaped outer face and wear pad being adapted so that the body weight is directed toward the center of the cleat so that said cleat wears from the inside out and that as the cleat wears from the inside out, said traction teeth also wear in an outward manner to allow said traction teeth to maintain said outward angle to continue to provide lateral traction throughout the life of the cleat.

12. The golf shoe cleat defined in claim 11 wherein said golf shoe cleat is molded from a polyurethane having a hardness range from about 45 D to about 95 D durometer hardness.

13. The golf shoe cleat defined in claim 11 wherein said threaded stud has a helical thread extending from the base of said main body member outwardly and at least one plastic fillet member bridging a portion of said thread so as to prevent loosening of said golf cleat during use.

14. The golf shoe cleat defined in claim 11 wherein said outward angulation is about 37½°.

15. The golf shoe cleat defined in claim 11 wherein each said perimeter traction tooth has a tip which is flat.

16. The golf shoe cleat defined in claim 11 wherein each said perimeter traction tooth has a peak which is rounded.

* * * * *